United States Patent [19]

Kyzer et al.

[11] Patent Number: 4,665,710

[45] Date of Patent: May 19, 1987

[54] BYPASS AND MONITORING CIRCUIT FOR REFRIGERATION SYSTEM

[76] Inventors: George Kyzer, 503 - 5th Ct., Palm Beach Gardens, Fla. 33410; James Smollon, 5827 S. 37 St., Green Acres, Fla.

[21] Appl. No.: 778,449

[22] Filed: Sep. 20, 1985

[51] Int. Cl.[4] ..... F25D 21/02

[52] U.S. Cl. ..... 62/155; 62/156; 62/234

[58] Field of Search ..... 62/155, 156, 234, 126, 62/128, 140, 151

[56] References Cited

U.S. PATENT DOCUMENTS

| | | | |
|---|---|---|---|
| 4,173,871 | 11/1979 | Brooks | 62/155 X |
| 4,299,095 | 11/1981 | Cassarino | 62/156 X |
| 4,392,358 | 7/1983 | Hicks | 62/155 |
| 4,406,133 | 9/1983 | Saunders et al. | 62/156 X |
| 4,407,138 | 10/1983 | Mueller | 62/155 X |

*Primary Examiner*—Harry Tanner
*Attorney, Agent, or Firm*—Harry W. Barron

[57] ABSTRACT

Described herein is a refrigeration defrost cycle monitoring and bypass circuit which monitors the condition of the defrost terminator switch. More specifically, the circuit monitors whether the defrost terminator switch is stuck in either the open or the closed position. This is accomplished using timers to determine the period of time of the defrost cycle and the period of time the terminator switch is open. If either of these times exceed preset values, the defrost terminator switch function is eliminated from the circuit and the control it normally performs is substituted by predetermined times. This occurs by providing a resettable ground to the defrost relay so that it can sense the need to defrost and initiate a defrost cycle. After a defrost cycle is initiated, a user selectable timer ends the defrost cycle after the selected time.

19 Claims, 4 Drawing Figures

BYPASS AND MONITORING CIRCUIT FOR REFRIGERATION SYSTEM

This invention relates to a bypass and monitoring circuit for a refrigeration system and more particularly to such a circuit for monitoring the operation of the defrost reset switch and for overriding such switch upon its inoperability.

Conventional commerical refrigeration units such as the type used on tractor trailer vans, train cars or shipboard containers generally include an automatic defrost feature. The automatic defrost apparatus includes a sensor to detect the need to defrost a defrost relay which when set by the sensor, causes hot gases to circulate through the refrigeration coils and a defrost reset switch to reset the relay. The hot gases melt the ice on the coils thereby causing the defrosting action. The defrost reset switch operates in response to another sensor, which is attached to the coil and which measures the temperature, such that when the temperature exceeds a certain value of, for instance 45 degrees, the defrost reset switch is opened, thereby resetting the defrost relay and ending the defrost cycle. An exmaple of such a refrigeration unit is the Thermo King Model NWD50-56.

One of the most common problems in these commercial refrigeration units is that the coil temperature sensing device malfunctions, thereby causing the defrost reset switch to become stuck in the open or the closed position. Such a malfunction can cause the refrigeration unit to either never be defrosted or to continually stay in the defrost mode. In either situation, and particularly the later situation, the temperature within either the trailer car or container will raise, possibly destroying or damaging the entire shipment of refrigerated products.

Other types of defrosting systems utilize a fixed timing sequence rather than sensors to initiate and terminate the defrost modes of operation. For example, a timer may be included which is set to cause a fifteen minute defrost cycle to occur every four hours. The problem with these types of systems is that the refrigeration unit is not being defrosted at the optimum time, nor is the defrost cycle selected to be the optimum time. Examples of patents showing such systems include U.S. Pat. Nos. 4,411,139 to Bos, 4,327,556 to Zampini et al., 4,142,374 to Ansted et al., 4,332,141 to Mueller et al. and 4,392,358 to Hicks.

What is lacking in the prior art is a system which has the effectiveness of defrosting only when required and only for a period of time required combined with a timing system for overriding the on-demand system when it malfunctions.

In accordance with one aspect of this invention there is provided a bypass and monitoring circuit for use with a refrigeration system having means to sense a need to initiate a defrost cycle and means to reset the defrost cycle upon sensing the defrosting of the refrigeration system. The circuit comprises means to sense whether the duration of each defrost cycle exceeds a certain period and means responsive to the sensing means sensing that the duration of the given cycle exceeded the certain period for electrically decoupling the reset means from the refrigeration system, for resetting the given defrost cycle and for enabling the occurrence and controlling the duration of subsequent defrost cycles.

One preferred embodiment of the subject invention is hereafter described with specific reference being made to the following Figures, in which.

Figure 1:
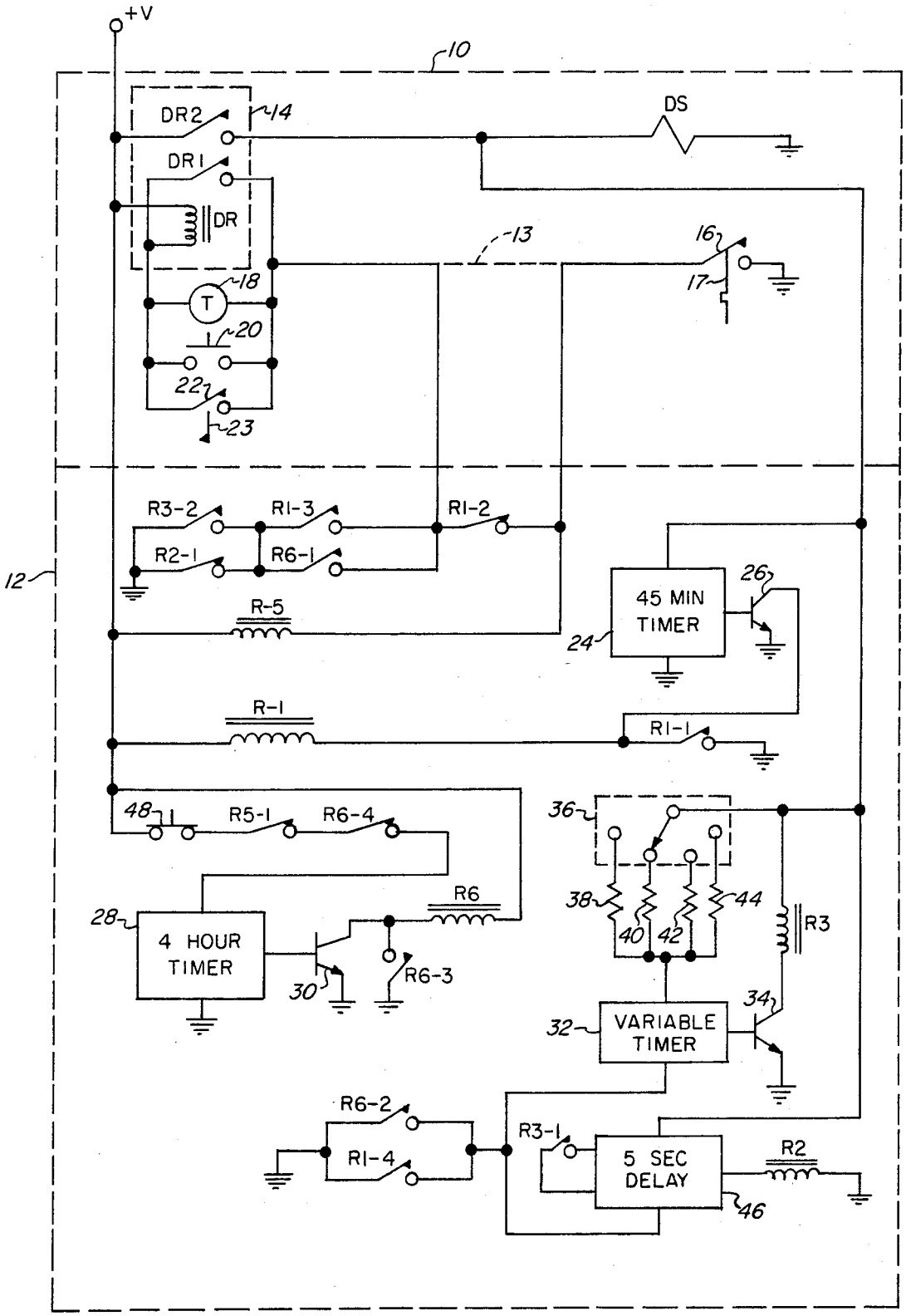
FIG. 1 shows a schematic diagram of the bypass and monitoring circuit of the present invention.

Referring to FIG. 1, existing refrigeration defrost system 10 is shown to which is coupled monitoring and bypass circuit 12. It should be understood that refrigeration system 10 only includes those portions thereof necessary understanding the defrosting operation or necessary for coupling to the monitoring and bypass circuit 12.

The refrigeration defrost system 10 includes defrost relay 14 which includes a DR coil and a pair of contacts DR1 and DR2.

In addition refrigeration defrost system 10 includes a defrost terminator switch 16, one end of which is coupled to ground. Switch 16 may be a contact of a relay energized by a sensor 17 and the other end of which is coupled to one side of contact DR1 over line 13 prior to the connection of circuit 12 physically positioned on the coil of the refigeration system. As long as the temperature of the refrigeration system coil is below 45 degrees defrost terminator switch 16 is maintained closed. whenever the temperature of the coil exceeds 45 degrees the coil sensor 17 ceases energizing the relay and switch 16 becomes open.

The coil DR of relay 14 is coupled between the system voltage +V and end of relay contact DR1 remote from switch 16. The DR2 contact is coupled between voltage +V and a defrost solonoid DS which operates during the defrost cycle to, for instance, close a door, when voltage is applied thereto by the closing of contact DR2. The other end of defrost solonoid DS is coupled to ground.

Three switching elements, timer 18, manual switch 20 and frost sensor 22, are coupled in parallel with contact DR1. Timer 18 may be set to become a closed switch after a given time unless previous thereto one of switch 20 or sensor 22 becomes closed only in response to a manual depression thereof. Frost sensor 22 includes a switch 22 closed in response to air pressure differential sensor 23 which measures the difference in air pressure from two openings, one of which is affected by the buildup of frost on the coils.

The manner in which the defrost system operates is that during a defrost cycle the defrost relay 14 is energized by the closure of one of switches 18, 20 or 22. Energized relay 14 causes hot gas to flow through the refrigerator coil by means not shown rather than the normal refrigerant, to thereby raise the temperature of the coil above 45 degrees. The hot gas, in turn causes the ice attached to the coil to melt thereby causing the defrost action. Until the ice has completely melted the temperature on the outside of the refrigeration coils remains at or below 32 degrees and the defrost terminator switch 16 is held closed by sensor 17. As soon as the ice has completely melted, the temperature of the refrigerator coil quickly increases to above 45 degrees, and sensor 17 causes defrost terminator switch 16 to open. Thereafter, refrigerant is applied through the refrigerator coils, causing sensor 17 to sense the below 45 degree condition and cause switch 16 to close. When defrost terminator switch 16 opens, an open circuit in the current path through the DR coil of defrost relay 14 results, thereby allowing switches DR1 and DR2 to open. This action ends the defrost cycle and returns the refrigeration system back to a normal cooling cycle.

As long as switch 16 is closed, ground is connected to one end of either timer 18, manual switch 20 or air pressure differential sensor switch 22. When switch 22 become closed a circuit is completed through the defrost relay 14 coil DR, thereby causing contacts DR1 and DR2 to close contact DR1 thereafter one end of coil DR connected to ground through switch 16. Contact DR2 and others (not shown) allow the defrost process to continue until the ground path to coil DR is interrupted by the opening of switch 16.

In the event that switch 22 or its associated sensor 23 becomes inoperative, the defrost process can still occur by timer 18 closing the circuit after a preset time or by depressing manual switch 20. Thus, both timer 18 and manual switch 20 operate as backup to the normal sensing air pressure differential switch 22. While the switch 22, causing a commencement of the defrost cycle, has backups, the defrost terminator switch 16 and its associated sensor 17, which ends the defrost cycle, does not have a backup system. In the event switch 16 becomes stuck in the closed position it would be impossible to end a defrost cycle once initiated. On the other hand, in the event switch 16 becomes stuck in the open position, it would be impossible to initiate a defrost cycle. In either case the refrigerator system would not maintain the proper refrigerator temperature for the cargo. This is particularly true if refrigerator defrost system 10 became stuck in the defrost mode with switch 16 stuck closed.

The monitoring and bypass circuit 12 is provided to monitor the condition of defrost terminator switch 16 and to take over the defrost cycle timing in the event of a malfunction of switch 16. Circuit 12 includes a series of relays R1, R2, R3, R5 and R6, each of which have one or more contacts associated therewith. More specifically, relay R1 has contacts R1-1 through R1-4; relay R2 has contacts R2-1; relay R3 has contacts R3-1 and R3-2; relay R5 has contacts R5-1; and relay R6 has contacts R6-1 through R6-4. In addition, circuit 12 includes a 45 minute timer circuit 24 having an associated output driver transistor 26 and a four hour timer 28 having an associated output driver transistor 30. Further, circuit 12 includes a variable timer 32 having an associated output transistor 34. The variable time is determined by the setting on a four way rotary switch 36 which connects one of resistors 38, 40, 42 or 44 to the voltage input side of variable timer 32. The time selected may be eight, thirteen, seventeen or twenty-one minutes, depending on the size of resistors 38, 40, 42 and 44 and the associated timing capacitors (not shown) coupled to timer 32. Finally, circuit 12 includes a five second delay circuit 46.

Relay contact R1-2, which is a normally closed contact, is inserted between switch 16 and the ends of contact DR1, timer 18, manual switch 20 and air pressure differential switch 22 remote from the coil DR of the defrost relay 14. The junction of contact R1-2 and switch 16 is coupled through the coil of relay R5 to the source of positive voltage +V. Thus, during proper operation of the refrigeration unit, relay R5 is energized except for the short duration that switch 16 is opened terminating the defrost cycle.

The side of contact R1-2 remote from switch 16 is coupled to one side of respective normally open relay contacts R1-3 and R6-1. The other side of contact R1-3 is coupled to one side of normally open relay contact R3-2, the other side of which is coupled to ground. The other side of relay R1-3 is also coupled to the other side of relay R6-1, the junction of which is coupled through normally closed relay contact R2-1 to ground.

The junction between relay contact DR2 and the DS solenoid is coupled as the voltage input to forty-five minute timer 24. Forty-five minute timer 24 is designed such that if a positive (high) voltage is applied thereto for forty-five minutes without interruption, a pulse is provided at the output thereof. The pulse from forty-five minute timer 24 is applied to the base of transistor 26. Under normal operation, the voltage at the junction of relay contact DR2 and the DS solenoid will be high for much less than forty-five minutes, since it takes only about ten to twenty minutes to defrost the refrigeration coils. If the voltage between contact DR2 and the DS solenoid is high for forty-five minutes, this indicates that switch 16 has stuck in the closed position and is prevented from being opened for some reason.

The output pulse from forty-five minute timer 24 renders transistor 26 conductive, thereby coupling a ground volrage to one side of relay coil R1. The other side of relay coil R1 is coupled to positive voltage plus V. Thus, when transistor 26 is energized by the pulse from timer 24, relay R1 becomes energized. Normally open contact R1-1 of relay R1 is coupled from the junction of the collector of transistor 26 and the coil of relay R1 to ground. Upon the energization of the coil of relay R1, contact R1-1 closes thereby maintaining relay R1 permanently energized.

Four hour timer 28 provides an output pulse to the base of transistor 30 if a high voltage is applied thereto for a period of four hours. The voltage plus V is applied to four hour timer 28 through normally closed manual switch 48 normally clsoed relay contact R5-1 and normally closed relay contact R6-4. Manual switch 48 is normally placed in a closed position, unless the contents being refrigerated are above forty-five degrees which would result in switch 16 being normally opened. Relay contact R5-1 is closed only when switch 16 is open to break the connect path through the coil of relay R5. Relay contact R6-4 remains closed until four-hour timer 28 times out one time, after which it is permanently opened.

The purpose of four hour timer 28 is to make sure switch 16 does not remain open once the defrost cycle is terminated. If this occurs, no future defrost cycles can be initiated. The four hour time is determined from the facts that no major harm will result if the defrost cycle does not occur more often than once every four hours and switch 16 should close within four hours. The functional difference between four hour timer 28 and forty-five minute timer 24 is that four hour timer 28 measures the ability to defrost between defrost cycles and forty-five minute timer measures the duration of each defrost cycle. Stated another way, the difference between four-hour timer 28 and forty-five minute timer 24 is that four-hour timer 28 determines if switch 16 is stuck open and forty-five minute timer 24 determines if switch 16 is stuck closed.

The output pulse from four hour timer 28 renders transistor 30 conductive thereby applying ground to one side of the coil of relay R6. The other side of the R6 coil is attached to voltage plus V. When transistor 30 becomes conductive the relay of coil R6 is energized, thereby causing each of the contacts in R6 to change states. Normally open contact R6-3 is coupled between the transistor 30, coil of relay R6 junction and ground and when closed, permanently energizes the coil of relay R6. The energizing of the coil of relay R6 also opens contacts R6-4, thereby permanently removing the voltage from four hour timer 28 so that it only operates one time.

The time at which variable timer 32 provides a pulse at its output depends on the setting of rotary switch 36 with respect to one of resistors 38, 40, 42 and 44 as the power input to timer 32 and whether variable timer 32 is enabled. The switch arm of four way rotary switch 36 is coupled to the junction between contact DR2 and the DS solenoid, where, as previously noted the voltage is high only during the defrost cycle. If defrost cycle lasts longer than the time determined by the particular setting of rotary switch 36 an output pulse may be provided at the output of variable timer 32. However, such output pulse can only be provided if variable timer 32 is enabled by being attached to ground through one of parallel relay contacts R6-2 and R1-4. If either of these relays is closed as a result of one of timers 24 or 28 timing out, then variable timer 32 is operable. When operable, variable timer 32 provides a pulse for the duration of the selected time, wherever a high voltage appears at the junction of defrost relay contact DR2 and the DS solenoid.

The pulse applied from the output of variable timer 32 renders transistor 34 conductive, thereby energizing the coil of relay R3, which is connected between the collector of transistor 34 and the junction between defrost relay contact DR2 and the DS solenoid. The coil of relay R3 can only be energized during the time period determined by variable timer 32 and only during the time that the defrost cycle is occurring.

Five second delay circuit 46 is coupled to ground through the same R6-2 and R1-4 parallel relay contacts as was variable timer 32. Voltage is applied to five second delay from the junction between relay contact DR2 and the DS solenoid. Five second delay 46 operates such that when relay contact R3-1 is closed an output signal is provided from delay 46. This output signal for five seconds after contact R3-1 opens. The output from delay circuit 46 energizes the coil of relay R2, the other end of which is coupled to ground.

The operation of monitoring the bypass circuit 12 will now be described using the two situations of defrost terminator switch 16 being stuck in the closed position or being stuck in the open position. First, when switch 16 is stuck in the closed position, at some point in time one of timer 18 manual switch 20 or air pressure differential switch 22 becomes closed, thereby energizing the coil of defrost relay 14. This, in turn, closes relay contact DR1 and DR2. Contact DR1, when closed, maintains a ground connection through switch 16 for the coil of defrost relay 14 as previously explained. The closure of contact DR2 allows the defrost cycle to occur and causes the junction between contact DR2 and the DS solenoid to become plus V volts. If this voltage remains high for forty-five minutes, which would be the case if switch 16 is stuck in the closed position, timer 24 provides an output pulse to transistor 26 which energizes the coil of relay R1. Thereafter, relay contacts R1-1, R1-3 and R1-4 close and relay contact R1-2 opens. Contact R1-1 maintains a ground path to the coil of relay R1, thereby keeping in permanently energized. Contact R1-2 opens the circuit between switch 16 and the coil DR of defrost relay 14. Contact R1-3, when closed, provides a ground path through normally closed relay contact R2-1, to maintain a ground at the ground end of defrost relay 14.

The energizing of relay R1 also closes contact R1-4, which provides ground to both variable timer 32 and five second delay 46. Upon the connection of the ground signal to variable timer 32, a pulse signal is provided at the output thereof to render transistor 34 conductive, thereby energizing the coil of relay R3. This, in turn, closes relay contact R3-1 to energize the output of five second delay 46, thereby energizing the coil of relay R2. With relays R2 and R3 energized, contact R3-2 closes and contact R2-1 opens. This maintains the ground signal provided to the ground side of defrost relay 14.

After the preset time determined by the setting of rotary switch 36, the output of variable time 32 becomes low, thereby removing the energy from the coil of relay R3 and causing contact R3-2 to open, thereby removing the ground connection from the ground side of defrost relay 14. This resets the coil of defrost relay 14, thereby opening contacts DR2 and DR1.

In addition, removing the energy from the coil of relay R3 opens contact R3-1 which, in turn, causes the output of five second delay circuit 46 to become low five seconds later. Upon the output of five second delay circuit 46 becoming low, the energy to the coil of relay R2 is removed, thereby causing contact R2-1 to return to the normally closed position. This, in turn, regrounds the ground side of defrost relay 14 so that upon sensing the need to defrost, by for instance air switch 22 closing, the defrost cycle can be reinitiated. When this occurs, voltage is again provided through rotary switch 36 and the selected one of the resistors 38, 40, 42 and 44 to variable timer 32 which provides a output voltage for the selected time. At the end of this selected time, delay circuit 46 maintains relay R2 energized for five seconds, thereby removing the ground path from the ground side of defrost relay 14, for that five seconds. Thus, the defrost cycle time is determined by variable timer 32 rather than switch 16.

In summary, whenever defrost terminator switch 16 becomes stuck in the closed position, the forty-five minute timer 24 is triggered and opens circuits the junctions from switch 16 to defrost relay 14 by opening contact R1-2. Thereafter, the timing mechanisms of variable timer 32 and five second delay 46 cause the ground signal to be applied to the ground side of defrost relay 14 for a preset time after defrost relay 14 is energized by one of timer 18, manual switch 20 or air pressure differential sensing switch 22. The preset time is based on the amount of time that a defrost cycle should take based on the contents carried in the refrigerated compartment.

In the event that defrost terminator switch 16 becomes stuck in the open position, it becomes impossible to ever energize defrost coil 14 and thus to defrost the coils of the refrigeration system. The stuck open condition is sensed by four hour timer 28, which provides a pulse if relay R5 had been deenergized for a four hour period, that is, if contact R5-1 remains on its normally closed position for four hours. It should be noted that relay R5 is only de-energized when switch 16 is in the open position and this should normally only occur for a short time at the end of each defrost cycle. With relay R5 deenergized, contact R5-1 returns to the normally closed position providing a path for the voltage to four hour timer 28. After four hours, an output pulse from four hour timer 28 energizes transistor 30 which provides an energy path for the coil of relay R6. This energy path causes contact R6-3 to close and maintain relay R6 permanently energized. With the coil of relay R6 energized, contact R6-4 opens, thereby removing the input voltage to four hour timer 28 so that it can only operate that one time.

In addition, the energization of the coil of relay R6 closes contact R6-2, thereby applying ground to both variable timer 32 and five second delay 46. It also closes contact R6-1 so that a ground path exists through normally closed contact R2-1 and now closed contact R6-1 to the ground side of defrost relay 14. This allows defrost relay 14 to be energized by operation of one of timer 18, manual switch 20 or air pressure differential sensor 22. Upon energizing defrost relay 14, contact DR2 is closed providing energy through switch 36 on the selected one of the resistors 38, 40, 42 or 44 to variable timer 32. This, in turn, starts the defrost timing cycle selected by the switch arm of switch 36. After the end of that selected period, the five second delay circuit 46 maintains relay R2 energized so that contact R2-1 remains open and contact R3-2 is in the normally open state, thereby removing the ground from the ground side of defrost relay 14. This, in turn, ends the defrost cycle. After the five second delay contact R2-1 returns to the normally closed position thereby providing a ground path through contact R6-1 to allow defrost relay 14 to be energized upon the proper conditions sensed by either timer 18, manual switch 20 or air pressure differential sensor 22.

Thus if defrost terminator switch 16 becomes stuck in the open position, this is sensed after a four hour time period and thereafter defrosting occurs for the time set by the position of the switch arm of switch 36.

Figure 2:
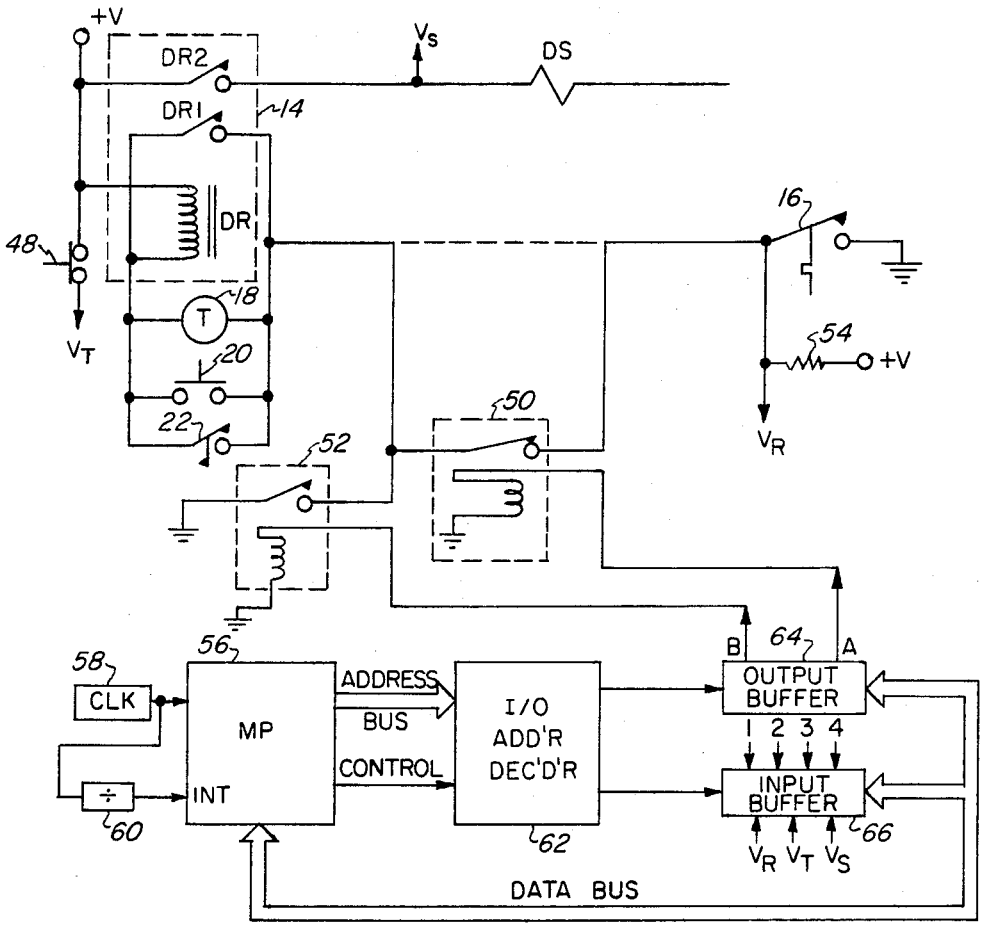
FIG. 2 shows an alternate embodiment of the bypass and monitoring circuit.

Referring now to FIG. 2, the invention is shown implemented using a microprocessor to perform the logic set out in the monitoring and bypass circuit 12 of FIG. 1. Where like components are used in the FIG. 2 circuit compared to the FIG. 1 circuit, like designations are given for those components.

In implementing the digital version of the monitoring and bypass circuit only two relays are required, these being relay 50 which is a normally closed relay placed in series between switch 16 and the defrost relay 14 and normally open relay 52 which is placed between the junction of relay 50 and defrost switch 15 and ground. Of course appropriate switching power transistors could be substituted for relays 50 and 52. From the basic refrigeration defrost system 10 shown in FIG. 1 three signals are generated which are respectively labeled $V_s$ $V_t$ and $V_r$. The $V_s$ signal is the voltage between the DR2 contact and the DS solenoid. The $V_t$ signal is the voltage at the output of manual switch 48, which was used in FIG. 1 to eliminate the four hour timer function. The $V_r$ signal is the voltage on the side, remote from ground, of switch 16. A pull up resistor 54 is coupled between the junction of the Vr signal and switch 16. Thus, the Vr signal is ground value when switch 16 is closed and +V, or high voltage, when switch 16 is open.

The monitoring and bypass portion of the FIG. 2 circuit includes a microprocessor 56 having an associated clock 58 and divide circuit 60 coupled therewith. Clock 58 is coupled to the clock input of microprocessor 56, which may be, for example, an Intel 8048 microprocessor that includes internal random access memory and read only memory. The output of clock 58 is also coupled through divider circuit 60 to an interrupt input of microprocessor 56. As with all microprocessors, microprocessor 56 includes both an address bus and a data bus. The address bus is coupled together with appropriate control signals to an Input/Output (I/O) address decoder circuit 62 which can select one of an output buffer 64 or input buffer 66 to respond to or provide signals to the data bus.

Output buffer 64 can be controlled to provide two signals A and B. The A signal is coupled to the coil of relay 50 and, when provided, causes the contact of relay 50 to open. The B signal from output buffer 64 is coupled to the coil of relay 52 and when a voltage is provided for the B signal, the contacts of relay 52 closes.

Input buffer 64 responds to each of the Vr, $V_t$ and $V_s$ signals, as well as four additional signals labeled as 1, 2, 3 and 4 which may determine the desired defrost time. Thus, the signals 1, 2, 3 and 4 correspond to the various values of resistors 38, 40, 42 and 44 shown in FIG. 1.

Figure 3:
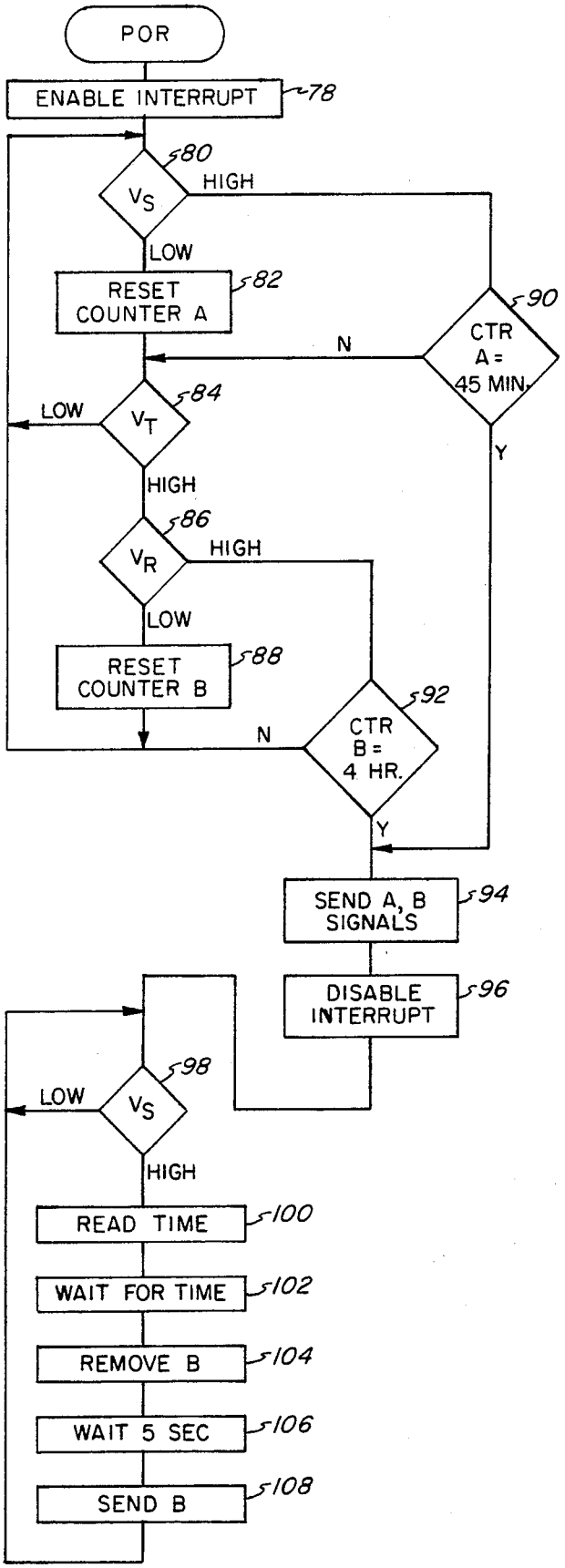
FIG. 3 shows a flow diagram of the program of the microprocessor shown in FIG. 2.

Referring now to FIG. 3, a flow diagram of the operation of microprocessor 56 and its associated circuitry is shown. Actual computer code can be generated from the flow diagram shown in FIG. 3 and stored in the read only memory of microprocessor 56.

Figure 4:
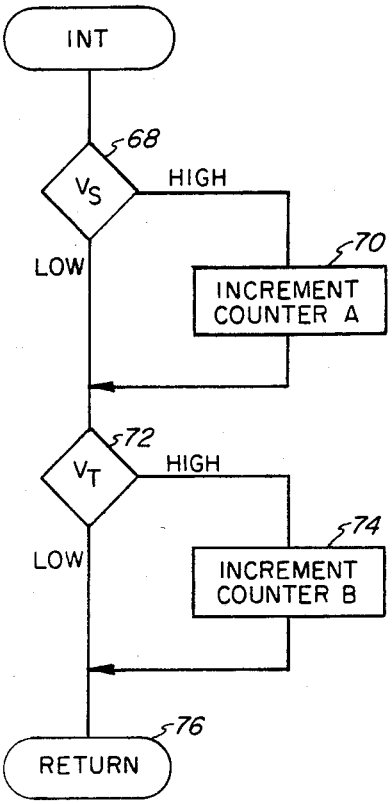
FIG. 4 shows a flow diagram of the interrupt routine for the microprocessor shown in FIG. 2.

Referring to FIG. 4 the interrupt portion of the flow diagram shown in FIG. 3 is illustrated. As is well known, whenever an interrupt occurs, the general flow shown in FIG. 3 is frozen in place and the interrupt routine is performed. At the end of the interrupt routine, a resumption of the general flow, shown in FIG. 3, continues from the point at which it was interrupted. As can be seen from FIG. 2, the interrupt input receives a signal from the output of the divide circuit 60. The divide circuit 60 is selected with respect to the frequency of the clock circuit 58 so that at periodic time intevals, of for example, once per second, a pulse is provided to the interrupt input of microprocessor 56. Upon the occurrence of each interrupt, the interrupt routine shown in FIG. 4 is performed.

First as indicated by block 68 a determination is made whether the Vs signal is high or low. This may occur by microprocessor 56 applying appropriate address and control signals to address decoder 62 to cause the input buffer 66 to send a signal over the data bus back to microprocessor 56 manifesting the state of the $V_s$ signal. If the $V_s$ signal is determined to be high, a counter, which may be part of the random access memory included in microprocessor 56 and labeled as counter A, is incremented. If the $V_s$ signal is determined to be low, block 70 is skipped and a continuation with block 72 occurs where the value of the $V_t$ signal is determined. This may be determined in the same manner by polling the input buffer 66. If the $V_t$ signal is determined to be high, then according to block 74, a second counter, known as counter B, is incremented. If $V_t$ is determined to be low block 74 is skipped. Thereafter as indicated by block 76 a return to the main flow shown in FIG. 3 occurs.

Referring again to FIG. 3, the main program is labeled POR for power on reset. This indicates that as soon as power is applied to microprocessor 56 and the remaining circuit elements shown in FIG. 2, the flow shown in FIG. 3 occurs. First according to block 78, the interrupt enable instruction is executed so that microprocessor 56 can respond to interrupts in the manner set out in FIG. 4. Next, according to block 80, the value of the $V_s$ signal is determined. If that signal is determined to be low, thereby indicating that defrost relay 14 is not set, block 82 indicates that the value in counter A is reset to zero. Next, according to block 84 the $V_t$ signal valve is determined. If it is determined to be low, thereby indicating that switch 48 is open and the four hour timing function is removed, a return to block 80 occurs. If the $V_t$ signal is found to be high, thereby indicating switch 48 is closed and is desired to perform a four hour test, then according to block 86 the value of the $V_r$ signal is determined. If this signal is determined to be low, then, according to block 88, counter B is reset to the value of zero and a return to block 80 occurs.

If at block 80, it was determined that the Vs signal was high, thereby indicating a defrost cycle was in process, then block 90 indicates that a determination is made whether the reading in counter A is equivalent to forty-five minutes. If it is not, a return to the main flow preceeding block 84 continues. Note that during the time that the Vs signal is determined as high, counter 82 is not reset, so that it is continually incremented at the interrupt rate until such time as the determination either at block 80 is that Vs is low or at block 90 is that counter A reading is equivalent to forty-five minutes.

If at block 86 it were determined that the Vr signal were high, thereby indicating that switch 16 was in the open position, then according to block 92, a determination is made whether the reading of counter B is equal to four hours. If not, a return to block 80 is indicated.

If at block 90 it were determined that the counter A reading was forty-five minutes or if at block 92 it were determined that the counter B reading was four hours, then the determination has been made that there is a malfunction in the general refrigeration defrost portion of the circuit and a continuation with block 94 occurs to disable switch 16 from the circuit and to control artificially the duration of the defrost portion of the cycle.

First at block 94, it is indicated that the A and B signals are sent from output buffer 64. This occurs by microprocessor 56 addressing decoder circuit 62 to select the output buffer. Then data is provided over the data bus from microprocessor 56 to output buffer 64 and the appropriate A and B signals are sent to energize the coils of relay 50 and 52. This in effect opens the relay contacts of relay 50 and closes the relay contacts at relay 52.

Then at block 96 the interrupts are disabled, since it is no longer necessary to monitor the time either the A or the B counter. Next, at block 98 a determination is made of the value of the $V_s$ signal. If the Vs signal is low thereby indicating no defrost is occurring a return to the beginning of block 98 occurs. When at block 98 it is determined that the Vs signal is high, block 100 indicates that the selected time is read. This occurs by determining which of the signals 1, 2, 3 or 4 has been selected by reading the input buffer in the manner previously explained. Next, according to block 102 the selected time is waited and according to block 104, the B signal is removed. This effectively opens the contacts of relay 52, thereby removing the ground to the DR coil and terminating the defrost cycle. Next, according to block 106, a five second wait occurs and thereafter at block 108 the B signal is sent again, thereby closing the contacts of relay 52 so that a subsequent defrost can occur when indicated by one of timer 18, switch 20 or sensor 22. Thereafter, a return to the beginning of block 98 occurs where the Vs signal is again monitored until the next defrost cycle is detected.

Thus, it is seen that the digital version of the circuit shown in FIG. 2 and operated as indicated in FIGS. 3 and 4 monitors the position of switch 16 and when it finds that switch 16 is stuck in either the open or the closed position, it thereafter controls the duration of the defrost cycle.

What I claim is:

1. A bypass and monitoring circuit for use with a refrigeration system having means to sense a need to initiate a defrost cycle and means to reset said defrost cycle upon sensing the defrosting of said refrigeration system, said circuit comprising:

first means to sense whether the duration of each defrost cycle exceeds a certain period; and second means, responsive to said first means sensing that the duration of a given cycle exceeded said certain period, for electrically decoupling said reset means from said refrigeration system; for resetting said given defrost cycle and for enabling the occurrence of and controlling the duration of subsequent defrost cycle.

2. The invention according to claim 1 wherein said first means includes a timer which is enabled at the initiation of each defrost cycle, and which provides a signal said certain period after being enabled, unless reset prior thereto by the termination of said defrost cycle.

3. The invention according to claim 2 wherein said timer is disabled upon said means to reset sensing the completion of the defrosting of said refrigeration system and terminating said defrosting.

4. The invention according to claim 2 wherein said timer is enabled only during the time the refrigeration system is being defrosted.

5. The invention according to claim 1 wherein said second means includes a normally closed relay serially coupled between said means to reset and said means to initiate.

6. The invention according to claim 5 wherein said relay is opened in response to said first means sensing that the duration of said defrost cycle exceeds said certain period.

7. The invention according to claim 6 wherein said second means includes timing means enabled when said relay is opened and means responsive to said enabled timing means for resetting said means to initiate after a given time.

8. In a circuit for use with refrigeration system having means to sense a need to and to initiate a defrost cycle and terminator switch means operable to reset said defrost cycle upon sensing the defrosting of said system, said terminator switch means further enabling said means to sense a need to and to initiate said defrost cycle, an improvement comprising:

first means responsive to the operation of said terminator switch means for sensing whether the duration between successive operations of said terminator switch means exceeds a certain period; and second means responsive to said first means sensing that said duration exceeded said certain period for enabling the initiation of and controlling the duration of subsequent defrost cycles.

9. The invention according to claim 8 wherein said first means includes timing means which is reset each time said terminator switch means operates, and which provides a signal said certain period after being reset.

10. The invention according to claim 9 wherein said second means includes means for detecting the beginning of each defrost cycle and timing means, enabled by said first means timing means signal, for resetting said defrost cycle.

11. The invention according to claim 10 wherein said first means timing means is disabled after said signal is provided thereby.

12. The invention according to claim 9 wherein said first means timing means is disabled after said signal is provided thereby.

13. A circuit for use with a refrigeration system having defrost means including means to sense a need to defrost and means, when enabled to initiate a defrost cycle and means to reset said defrost cycle and enable said means to initiate upon sensing the end of said defrost cycle, said circuit for sensing the malfunction of said reset means and replacing the function thereof, said circuit comprising:

first sensing means for sensing whether the duration of said system defrost cycle exceeds a first time period;

second sensing means for sensing whether the duration between the end of said defrost cycle and the enabling of said means to initiate exceeds a second time period; and cycle timing means for being initiated by one of said first or second sensing means sensing that the duration sensed thereby exceeds said respective first or second periods and, when initiated, for controlling the duration of each defrost cycle subsequent thereto.

14. The invention according to claim 13 wherein said first sensing means includes a resettable first timer which is reset prior to the initiation of a defrost cycle and which provides an output signal said first time period after the initiation of said defrost cycle unless said defrost cycle has been earlier reset, said first timer signal being provided to initiate said cycle timing means.

15. The invention according to claim 14 wherein said first sensing means further includes means to electrically decouple said reset means from said defrost means.

16. The invention according to claim 14 wherein said second sensing means includes a resettable second timer which is enabled upon each resetting of a defrost cycle and disabled by the enabling of said means to initiate, said second timer providing an output signal said second time period after being enable unless previously disabled prior to the expiration of said second time, said second timer output signal being provided to initiate said cycle timing means.

17. The invention according to claim 16 wherein said cycle timing means includes a third timer for determining the duration of said defrost cycle only after being initiated by one of said first or second timer output signals.

18. The invention according to claim 17 wherein said first sensing means further includes means to electrically decouple said reset means from said defrost means.

19. The invention according to claim 13 wherein said first sensing means further includes means to electrically decouple said reset means from said defrost means.

* * * * *